US008312829B2

(12) United States Patent
Black

(10) Patent No.: US 8,312,829 B2
(45) Date of Patent: Nov. 20, 2012

(54) BOAT HATCH WIND DEFLECTOR SYSTEM

(76) Inventor: Elaine Catherine Black, West Grove, PA (US)

( * ) Notice: Subject to any disclaimer, the term of this patent is extended or adjusted under 35 U.S.C. 154(b) by 169 days.

(21) Appl. No.: 12/849,033

(22) Filed: Aug. 3, 2010

(65) Prior Publication Data

US 2011/0100281 A1 May 5, 2011

Related U.S. Application Data

(60) Provisional application No. 61/231,469, filed on Aug. 5, 2009.

(51) Int. Cl.
*B63J 2/10* (2006.01)

(52) U.S. Cl. ..... 114/211; 454/78; 454/82

(58) Field of Classification Search ..... 114/177, 114/201 R, 203, 211; 454/78, 81, 82
See application file for complete search history.

(56) References Cited

U.S. PATENT DOCUMENTS

| | | | | |
|---|---|---|---|---|
| 4,434,740 | A * | 3/1984 | Childs | 114/211 |
| 4,941,422 | A * | 7/1990 | Muller | 114/203 |
| 5,339,759 | A * | 8/1994 | Peabody | 114/211 |
| 5,588,386 | A * | 12/1996 | Schilt | 114/211 |
| 5,778,816 | A * | 7/1998 | DiGiulio | 114/211 |
| 6,178,908 | B1 * | 1/2001 | Stolzenberger | 114/211 |
| 6,289,834 | B1 * | 9/2001 | Phillips | 114/211 |

* cited by examiner

*Primary Examiner* — Lars A Olson
(74) *Attorney, Agent, or Firm* — Joseph F. Aceto, Esq.

(57) ABSTRACT

A ventilator wind scoop system is disclosed for attachment to a boat deck hatch having a hinged hatch cover which opens to uncover the hatch opening whereby the scoop system communicates through such opening with the boat's below deck space. The scoop system has a deflector unit formed of wind-resistant fabric. The deflector, which is anchored to the inner face of the hatch cover and to supports inside the lower deck, is positioned as desired. The opposing portion of the deflector is anchored within the lower deck, preferably to the ceiling or sides to allow air flow to be forced to the front of the boat or in any direction needed. The wind scoop system is easily customized to fit a wide variety of hatch sizes and when not is use folds into a compact size for easy storage.

19 Claims, 4 Drawing Sheets

BOAT HATCH WIND DEFLECTOR SYSTEM

The present application claims the benefit of priority of U.S. Provisional Application No. 61/231469, filed Aug. 5, 2009, which is incorporated herein by reference.

BACKGROUND OF THE INVENTION

1. Field of the Invention

This application relates to boat hatch wind scoop systems. More particularly, it relates to redirecting air entering the below deck space of a boat from the opened hatch toward the bow.

2. Description of the Prior Art

Ventilation of the below deck space of sailboats, power boats and like marine craft is essential to the comfort of passengers, preservation of stores, prevention of mildew, etc. Larger craft frequently are provided with air conditioning equipment, but smaller craft and even larger sailboats do not enjoy this luxury. Hence, many marine craft must depend on more basic, passive ventilation devices such as scoop ventilators, hinged hatches, electric fans, etc.

Many boats with below deck space possess one or more hinged closure hatches opening through the deck and a number of ventilator devices have been devised for deflecting or otherwise facilitating flow of air below deck through such hatches, e.g., see U.S. Pat. Nos. 4,434,740; 4,706,593; 4,759,271; 4,938,123; 5,022,339; and 5,339,759. The present invention provides a further improved marine craft ventilation system to focus air flow to selective areas below deck.

The present invention provides for a wind scoop system that allows a controlled ventilation of below deck space through a hatch, primarily in the bow and V-area of the boat.

Another aspect of the present invention is that the wind scoop system can be easily dismantled when not in use and stored in a small size space.

A further aspect of the present invention is a wind scoop system that is capable of being marketed as a universal kit, easily customized to conform to the precise dimensions and configuration of a particular boat hatch to which the system is to be applied.

Other aspects of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The wind scoop system of the present invention includes a marine craft deck hatch having a hinged hatch cover which opens to uncover the hatch opening. When open, one side of a nylon fabric wind deflector is secured to the inside face of the cover. Adjustable strings, having a plastic keeper means to adjust and set the string length, is incorporated into the perimeter of the deflector and secures the deflector to the cover face, preferably through a pair of suction cups. Another set of adjustable strings secure the opposing side of the deflector to the ceiling and/or sides of the lower deck space, also preferably through a pair of suction cups attached to the surface. The adjustable strings, together with the deflector, determine the size and wind direction into the lower deck space. The system comprises (a) a flexible wind deflector such as nylon fabric, (b) an adjustment string attached to the perimeter of the deflector, and (c) a removable anchoring device such as a set of suction cups. These components are provided as a partially assembled kit for retrofitting to a boat hatch.

With a wind scoop system of the invention installed in a boat hatch as described, air will flow through the open hatch cover, down the hatchway, and channeled into the desired direction such as, but not limited to, the front of the boat.

DESCRIPTION OF THE PREFERRED EMBODIMENTS

Figure 1:
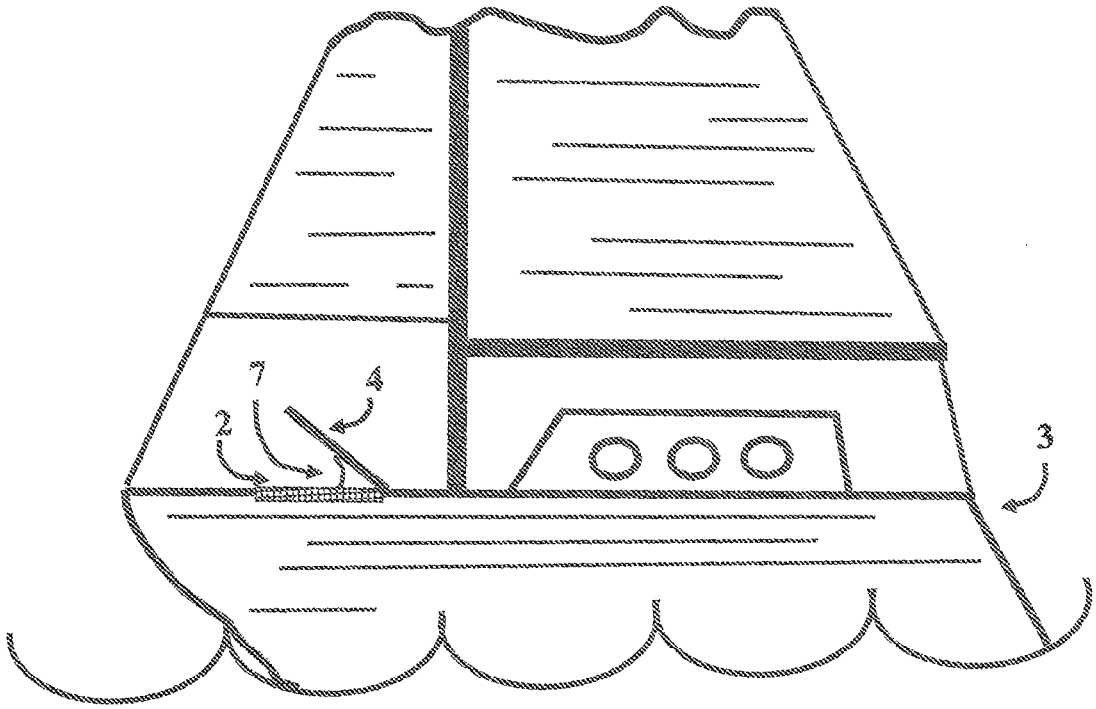
FIG. 1 is a lateral, outside view of a sailboat equipped with a wind scoop system of the present invention.
Figure 2:
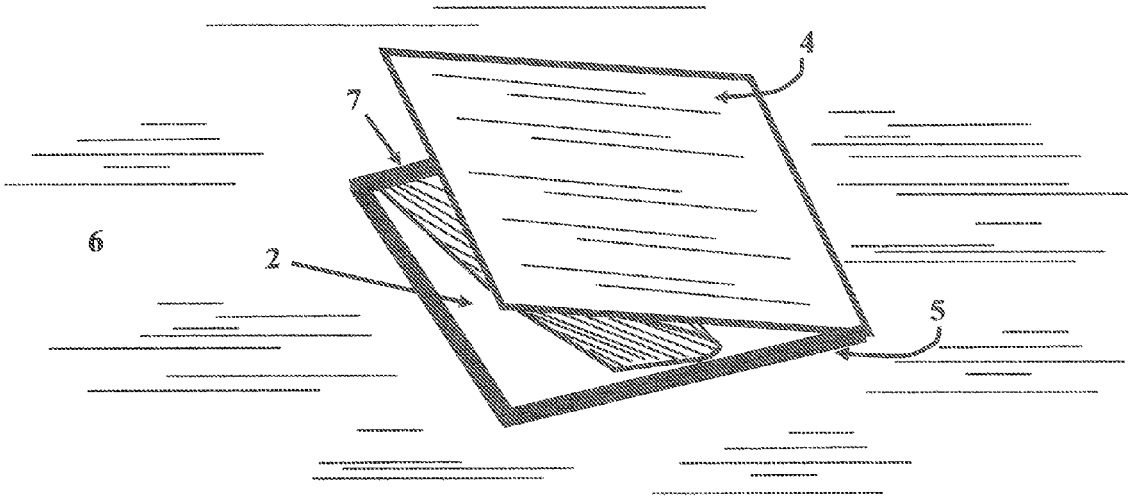
FIG. 2 is an isometric view of a wind scoop system with the hatch cover and deflector. The system is installed on the forward deck hatch of sailboat of FIG. 1.

Referring in detail to the drawings, the wind scoop system of the invention is attached to deck hatch 2 of sailboat 3. A hinged hatch cover 4 which opens to uncover the hatch opening, defined by a quadrilateral rim 5 to which the hatch cover 4 is hinged, so the system communicates through such opening with the space below the deck 6 of the sailboat 3.

The system comprises a nylon fabric deflector 7 anchored to the hatch cover 4 through a set of suction cups 8 or other attachment means linked together by adjustable strings 9. Other means can include the use of velcro® (synthetic attachment material composed of synthetic hooks and fiber material of surface loops, Velcro Industries) used alone or in combination with suction cups 8. The entire system is removable for storage and repositioning.

Figure 3:
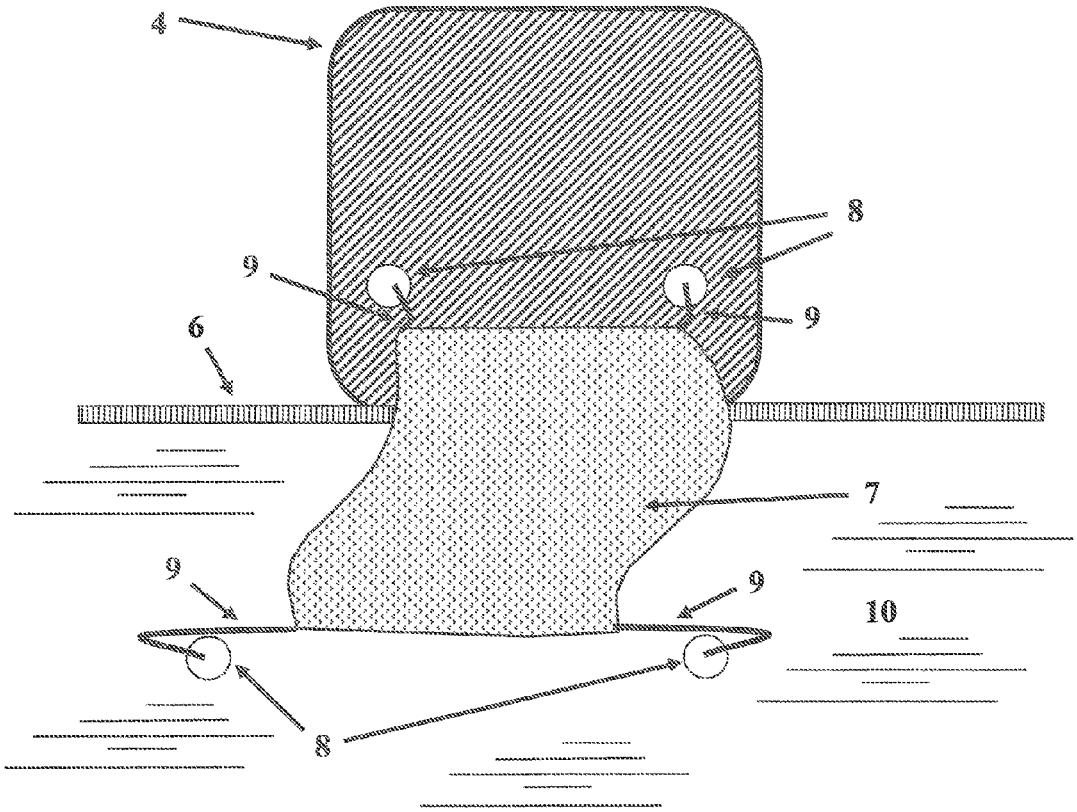
FIG. 3 is a front end view of the wind scoop system.
Figure 4:
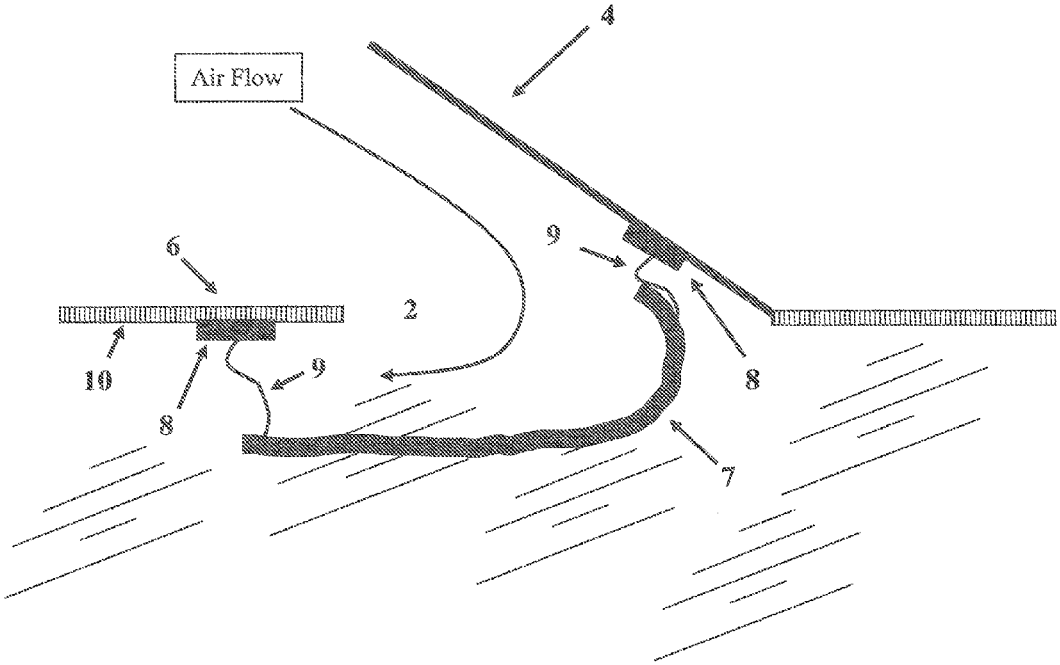
FIG. 4 is a lateral view of the wind scoop system.

As seen in FIG. 3, one side of the deflector is anchored to the hatch cover 4 by the suction cups 8 through the adjustable strings 9. The opposing side of deflector 7 is anchored to the ceiling or sides 10 of the lower deck to redirect air as it enters the hatch.

The wind scoop system of the present invention is readily customized to properly fit any particular hatch 4 of any boat, e.g., the sailboat 3, adjusting to fit all variations of hatch sizes. The universal application of the system to all variations of hatch sizes is an important feature since there are numerous different hatches currently installed in boats and incorporated into new construction. Typical hatches for installation of wind scoop systems will measure from about 18".times.18" to 25".times.24", but all sizes are considered. While all types of material know in the art are possible for the deflector composition, in general the deflector should be a flexible, wind-resistant sheet, film or fabric. The deflector can be composed of polymeric fabric, including but not limited to MYLAR, natural fabric, or flexible metals such as aluminum, One preferred embodiment is a nylon fabric for economical and ease of fabrication. Accordingly, the deflector 7 in the present invention is capable of being positioned to accommodate these characteristics and all hatch size ranges.

To begin installation, the deflector 7 through the adjustable string 9 is attached to a pair of suction cups 8. The suction cups 8 are secured to corner regions of the inner face of the hatch cover 4. The closer the suction cups are to the hinged portion of the cover, the easier and wider range of control obtained in directing air entering the lower deck.

Next, the deflector 7 is pulled through the hatch opening 2 and secured to the ceiling or sides 10 of the lower deck area with suction cups.

While suction cups 8 are described for attachment to the hatch cover 4 and lower deck ceiling or sides 10, the present invention considers any appropriate anchoring device that would secure the deflector 7 in position and keep it secured during air flow.

With the wind scoop system in place on the boat while the boat is at anchor, air will flow through the hatch opening as the boat will normally face the wind and air will flow through the opening 2 and down into the below deck space of the boat.

To dissemble the wind scoop system, release the suction cups within the lower deck, and then remove the suction cups from the inner face of the hatch. The removed system then compactly folds up for convenient storage in a locker.

Although the present invention has been described with reference to specific embodiments, workers skilled in the art will recognize that many variations can be made therefrom. It is to be understood and appreciated that this discovery in accordance with this invention are only those which are illustrated of the many additional potential variations that can be envisioned by one of ordinary skill in the art, and thus are not in any way intended to be limiting of the invention. Accordingly, other objects and advantages of the invention will be apparent to those skilled in the art from the detained description together with the claims.

I claim:

1. A wind scoop system for attachment to a marine craft deck hatch comprising:

a. a hinged hatch cover having an inside face;

b. a flexible wind deflector having two opposing sides;

c. means for attaching a first side of said deflector to the inside face of the hatch cover; and d. means for attaching a second side of said deflector to a surface inside the deck hatch.

2. The wind scoop system of claim 1 wherein said deflector consists of a material selected from the group consisting of a nylon fabric, polymeric fabric, a natural fabric and combinations thereof.

3. The wind scoop system of claim 1 wherein said means of attaching said deflector is adjustable strings.

4. The wind scoop system of claim 3 wherein said strings are attached to said hatch cover by suction cups.

5. The wind scoop system of claim 3 wherein said strings are attached to said hatch cover by a synthetic attachment material.

6. The wind scoop system of claim 1 wherein said means of anchoring the opposing side of said deflector is adjustable strings.

7. The wind scoop system of claim 6 wherein strings are anchored to the lower deck surface by suction cups.

8. A method for installing a wind scoop system on a water craft having a hatch opening and a hinged hatch cover having corners on an inner face comprising;

a. opening a craft deck hatch cover in the craft deck;

b. attaching a first side of a deflector having two opposing sides with a pair of adjustable strings to the corners of the inner face of the hatch cover whereby the closer the deflector is attached to the hinged portion of the cover, the wider range of air control into a lower deck;

c. pulling a second side of the deflector through the hatch opening; and d. attaching the second side of the deflector and a surface under the deck with a second pair of adjustable stings.

9. The method of claim 8 wherein the second pair of adjustable strings are attached to an under surface selected from the group consisting of the lower deck ceiling, the side, and combinations thereof.

10. The method of claim 9 wherein suction cups are used for attaching said adjustable strings to said hatch cover and said lower deck surface.

11. The method of claim 9 wherein a synthetic attachment material is used for attaching said adjustable strings to said hatch cover and said lower deck surface.

12. A boat hatch wind deflector kit for directing air through an open hatch on a deck of a water craft comprising:

a. a flexible wind deflector having two opposing sides;

b. means of attaching said deflector to said hatch cover on a first side of the deflector; and c. means of attaching a second side of said deflector to a surface under the deck of said craft.

13. The kit of claim 12 wherein said deflector consists of a material selected from the group consisting of polymeric fabric, a natural fabric and combinations thereof.

14. The kit of claim 12 wherein said means of attaching said deflector to said hatch cover is adjustable strings.

15. The kit of claim 12 wherein said means of anchoring the opposite side of said deflector to the lower deck surface is adjustable strings.

16. The kit of claim 14 wherein said strings are linked to suction cups for attaching to said hatch cover.

17. The kit of claim 14 wherein said strings are linked to a synthetic attachment material for attaching to said hatch cover.

18. The kit of claim 15 wherein said strings are linked to suction cups for attaching to said lower deck space.

19. The kit of claim 15 wherein said strings are linked to a synthetic attachment material for attaching to said lower deck space.

* * * * *